US012709884B2

(12) United States Patent
Kuru

(10) Patent No.: US 12,709,884 B2
(45) Date of Patent: Aug. 18, 2026

(54) GREY WATER RINSE TOILET

(71) Applicant: Kohler Co., Kohler, WI (US)

(72) Inventor: William Kuru, Plymouth, WI (US)

(73) Assignee: Kohler Co., Kohler, WI (US)

( * ) Notice: Subject to any disclaimer, the term of this patent is extended or adjusted under 35 U.S.C. 154(b) by 329 days.

(21) Appl. No.: 18/216,242

(22) Filed: Jun. 29, 2023

(65) Prior Publication Data

US 2024/0011270 A1 Jan. 11, 2024

Related U.S. Application Data

(60) Provisional application No. 63/359,971, filed on Jul. 11, 2022.

(51) Int. Cl.
*E03D 5/00* (2006.01)

(52) U.S. Cl.
CPC ..... *E03D 5/006* (2013.01)

(58) Field of Classification Search
CPC ..... E03D 5/003; E03D 5/006; E03D 5/016
USPC ..... 4/665, 340–342, 363, 364
See application file for complete search history.

(56) References Cited

U.S. PATENT DOCUMENTS

| | | | | |
|---|---|---|---|---|
| 5,642,533 | A * | 7/1997 | Young | E03D 1/144 4/363 |
| 7,325,258 | B2 * | 2/2008 | Asada | E03D 11/08 4/363 |
| 10,655,313 | B2 * | 5/2020 | Garrels | E03D 5/003 |
| 11,168,471 | B2 | 11/2021 | Garrels et al. | |
| 2018/0258630 | A1 | 9/2018 | Smith et al. | |
| 2021/0404153 | A1 | 12/2021 | Han et al. | |
| 2022/0107632 | A1 | 4/2022 | Sinha et al. | |
| 2022/0371932 | A1 | 11/2022 | Kwacz | |

* cited by examiner

*Primary Examiner* — Tuan N Nguyen
(74) *Attorney, Agent, or Firm* — Lempia Summerfield Katz LLC

(57) ABSTRACT

Provided is a grey water rinse toilet including a first reservoir configured to store a first water supply, a second reservoir configured to store a second water supply, a bowl having a first inlet fluidly connected the first reservoir and a second inlet fluidly connected to the second reservoir, a first valve disposed in the first inlet and configured to control a flow of the first water supply from the first reservoir to the bowl, and a second valve disposed in the second inlet and configured to control a flow of the second water supply from the second reservoir to the bowl. The flow of the first water supply may be configured to rinse an inner surface of the bowl.

19 Claims, 9 Drawing Sheets

GREY WATER RINSE TOILET

This application claims priority benefit of Provisional Application No. 63/359,971 filed Jul. 11, 2022, which is hereby incorporated by reference in its entirety.

FIELD

The present disclosure relates to a grey water rinse toilet. More specifically, the present disclosure relates to a grey water rinse toilet including a first valve and a second valve for controlling a flow of grey water and a flow of fresh water to the bowl of the toilet.

BACKGROUND

In consideration of environmental and economic concerns, it is advantageous to reduce the amount of fresh water used during a flush cycle of a toilet. Water is used to perform several functions during each flush cycle, for example, water is used to perform seal recovery, odor prevention, waste removal, bowl rinse, and drain line carry. Reducing an amount of water used with each flush may negatively impact one or more functions of the water during the flush cycle. Accordingly, there is a need for devices and methods for reducing an amount of fresh water used during a flush cycle, while maintaining intact performance of the several functions performed by water during the flush cycle.

BRIEF DESCRIPTION OF THE DRAWINGS

Exemplary embodiments of the present disclosure are described herein with reference to the following drawings, according to an exemplary embodiment.

DETAILED DESCRIPTION

Before turning to the figures, which illustrate certain exemplary embodiments in detail, it should be understood that the present disclosure is not limited to the details and methodology set forth in the detailed description or illustrated in the figures. It should be understood that the terminology used herein is for the purpose of description only and should not be regarded as limiting.

Described herein are toilets that use grey water and methods of flushing a toilet using grey water. Grey water is wastewater collected from the building (e.g., households) that does not contain fecal matter. Grey water may be collected from, for example, baths, showers, sinks, washing machines, dishwashers, and the like. According to embodiments of the present disclosure, grey water, in addition to fresh water, may be used during the flush cycle of a toilet. In some examples, the grey water may undergo one or more treatments before being conveyed to a toilet during a flush cycle of the toilet. For example, the grey water may pass through one or more filters, be subject to ultraviolet (UV) light, and/or have one or more cleaning chemicals added to it. In other examples, the greywater may be untreated before being conveyed to the toilet during a flush cycle.

Grey water may be used to perform or assist in performing one or more of the functions performed by water during each flush cycle, reducing the amount of fresh water (e.g., municipal water, well water, potable water) used during each flush cycle. For example, grey water may aid in waste removal and/or bowl rinse. In some examples, due to the quality of the grey water, all of the grey water used during a flush cycle may flow out of the toilet bowl during the same flush cycle in which the grey water flows into the bowl, so as to not remain in the bowl between flush cycles. For example, grey water may flow into the bowl and remove waste and/or rinse the bowl as the grey water flows through and out of the bowl during the flush cycle.

Figure 1:
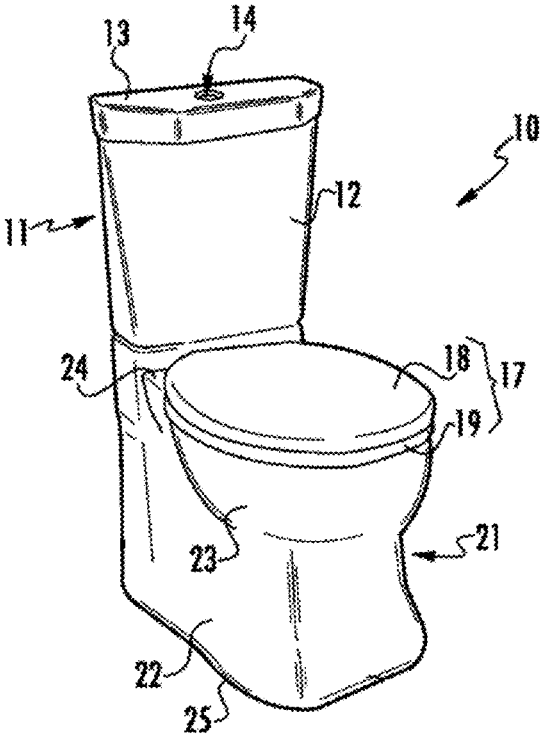
FIG. 1 illustrates a perspective view of a toilet, according to an exemplary embodiment of the present disclosure.
Figure 2:
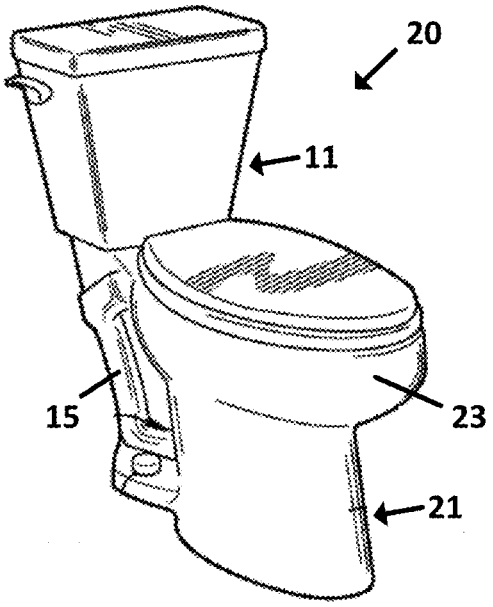
FIG. 2 illustrates a perspective view of a toilet according to an exemplary embodiment of the present disclosure.

FIGS. 1 and 2 illustrate toilets according to exemplary embodiments of the present disclosure. FIG. 1 illustrates an exemplary embodiment of a skirted toilet 10 that includes a tank 11, a pedestal 21 (or base), a seat assembly 17 and a coupling or mounting assembly. The tank 11 may include one or more hollow reservoirs 12 for storing the water used during operational (or flushing) cycles, a lid (or cover) 13 for providing selective access into the reservoirs 12, and an actuator 14 that is configured to initiate an operational cycle when activated. The actuator 14 or flush mechanism may be a button configured to activate when depressed (or pulled) a predetermined distance or when touched, a lever configured to activate when rotated a predetermined angular travel, or any suitable device configured to activate based upon an input manipulation by a user.

It should be noted that the shapes and configurations of the tank, pedestal, seat assembly, and the internal components (including the trapway and other features) may vary from the embodiments shown and described herein, and that the embodiments disclosed herein are not intended as limitations. It should be noted that various components of the toilet may be made of vitreous china. It should be noted that various components of the toilet may be polymeric and/or over molded or otherwise fixed to the toilet. It should be noted, for example, that although the exemplary embodiment of the toilet 10 is shown configured with the tank 11 formed separately from the pedestal 21 and later coupled to the pedestal, the tank may be integrally formed with the pedestal as a one-piece design. In other words, the toilet may be a one-piece design, a two-piece design, or have any suitable configuration. The toilet disclosed herein may have a wide variety of skirted toilet configurations, and all such configurations are intended to be encompassed herein. The following description of various toilet features is therefore intended as illustration only of one possible embodiment, and it should be understood by those reviewing the present description that similar concepts or features may be included in various other embodiments.

The tank 11 may include an inlet opening configured to receive water from a coupled water supply, such as from a hose (e.g., line, tube). The tank 11 may also include an inlet valve assembly or other device configured to control the flow of water from the water supply into the tank through the inlet opening. In some examples, the tank 11 may include both an inlet opening and inlet valve assembly configured to control a flow of freshwater into the tank 11 and an inlet opening and inlet valve assembly configured to control a flow of grey water to the tank 11. Within the tank 11 may be provided a float device for controlling each of the inlet valve assemblies, such as by opening the valve to refill the reservoir(s) 12 of the tank 11 after an operational cycle and closing the valve when the water in the reservoir(s) 12 reaches a preset volume or height. The tank 11 may also include an outlet opening configured to transfer (e.g., conduct) the water stored in the reservoir 12 of the tank to the pedestal 21 upon activation of the actuator 14. The pedestal 21 may include toilet bowl 23. The tank 11 may include an outlet valve assembly or other device configured to control the flow of water from the tank into the pedestal 21 through the outlet opening. In some examples, the tank 11 may include both an outlet opening and outlet valve assembly configured to control a flow of freshwater into the pedestal 21 and an outlet opening and outlet valve assembly configured to control a flow of grey water into the pedestal 21.

The pedestal 21 (or base) of the toilet 10 may include a wall 22 having any suitable shape that is configured to form a bowl 23 having an opening formed by an upper rim at the top of the opening. The pedestal 21 may also be configured to include a plurality of walls having varying shapes that together form a bowl having an opening formed by a rim. The wall 22 of the pedestal may extend downward and/or rearward from the bowl 23 to form a lower portion 25 configured to support the pedestal 21 and the toilet 10. The lower portion 25 may be formed by the end (e.g., lower rim) of the wall 22, or may include a member that extends generally in a horizontal plane from one or more than one end of the wall. The pedestal 21 may also include a top member 24 that extends between two sides of the wall 22 (or between two opposing walls) and is provided rearward (or behind) the bowl 23, wherein the top member 24 forms a plateau for supporting the tank 11, such as the bottom surface of the reservoir 12 of the tank 11. The top member 24 may include an inlet opening or inlet openings that may be aligned with the outlet opening(s) of the tank 11, such as when the tank 11 is coupled to (or resting above) the pedestal 21, wherein water is selectively transferred (e.g., conducted) from the tank 11 through the outlet opening(s) of the tank to the pedestal 21 through the inlet opening(s) of the pedestal 21, when the toilet is activated through the actuator 14. The outlet valve assembly may control the flow of water from the tank to the pedestal. The toilet may also include a gasket or seal that is provided between the tank 11 and the pedestal 21 to prohibit leaking. For example, a gasket may be provided between the outlet opening of the tank and the inlet opening of the pedestal to prohibit leaking between the tank and the pedestal.

The plateau formed by the top member 24 of the pedestal 21 may also provide for coupling of the seat assembly 17 to the pedestal 21 of the toilet 10. For example, the top member 24 may include one or more than one opening, wherein each opening is configured to receive a fastening device (e.g., bolt, screw, etc.) to couple (e.g., attach) the seat assembly 17 to the top member 24 of the pedestal 21. As another example, the top member 24 may include one or more than one fastening device (e.g., bolts, recessed nuts, etc.) integrally formed therein (i.e., already provided connected or coupled to the pedestal 21), wherein the fastening device may be used to couple or secure at least a portion of the seat assembly 17 to the pedestal 21.

The bowl 23 of the pedestal 21 may be configured to include a receptacle (e.g., sump) and an outlet opening, wherein the water and waste is collected in the receptacle until being removed through the outlet opening, such as upon activation of the actuator 14. The pedestal 21 may also include a pedestal internal passageway, such as a trapway, that connects the outlet opening or discharge outlet of the bowl 23 to a drain or soil pipe. The passageway, or trapway, generally includes a first portion, a second portion, and a weir separating the first and second portions. The first portion of the passageway may extend from the outlet opening of the bowl 23 at an upwardly oblique angle to the weir. The second portion of the passageway may extend from the weir downwardly to the exiting device, such as the drain or soil pipe.

Between operational cycles (e.g., flush cycles) of the toilet 10, the water (and waste) is collected in the first portion of the trapway (in addition to the receptacle of the bowl), such that the weir prohibits the water from passing past the weir and into the second portion of the trapway. A flushing cycle may begin upon activation of the actuator 14. Upon activation of the actuator, additional water (e.g., fresh water and or grey water) may be discharged into the bowl 23 of the pedestal 21, resulting in the flushing action and waste removal through the soil pipe. The flushing cycle may include generation of a siphon to assist the flushing action and waste removal.

The seat assembly 17 may include a cover member 18 (e.g., lid), a seat member 19 (e.g., ring member), and a hinge. The seat member 19 may be configured to include an annular member that encircles an opening, wherein the annular member provides a seating surface for the user of the toilet 10. The seat member 19 may also be pivotally coupled (e.g., attached) to the hinge, wherein the seat member may rotate (or pivot) about the hinge, such as between a first lowered or seated position and a second raised or upright position. The cover member 18 may be configured to be round, oval, or any other suitable shape. Typically, the profile or shape of the outer surface of the cover member will be configured to match (i.e., to be substantially similar) to the profile of the outer surface of the seat member to improve the aesthetics of the seat assembly and toilet. The cover member 18 may also be coupled to the hinge, wherein the cover member may rotate (or pivot) about the hinge, such as between a first down lowered or down position and a second raised or upright position. The cover member 18 may be provided above the seat member in the down position to thereby cover the opening of the seat member 19, as well as to conceal the inside of the bowl 23 of the pedestal 21. The cover member 18 may be configured to rest against the outside surface of the tank 11, when the cover member 18 is in the upright position, such that the cover member 18 remains in the upright position in order for a user to sit upon the seat member 19.

FIG. 2 illustrates a non-skirted toilet 20 according to another exemplary embodiment of the present disclosure. The internal components, including the trapway 15, are visible in the pedestal 21 of non-skirted toilet 20. It should be noted that the devices, methods, and systems described herein may include and/or be used with both skirted and non-skirted toilets.

Figure 3:
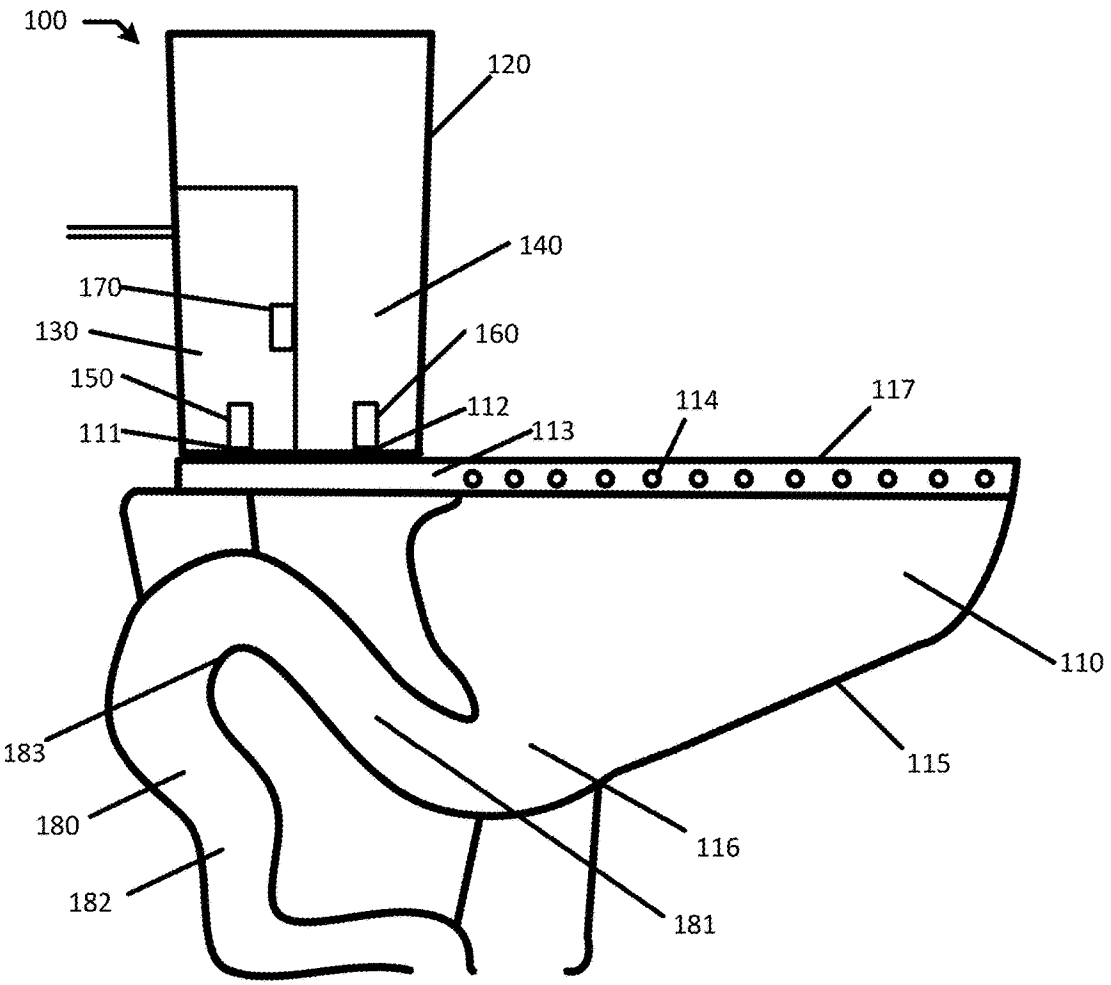
FIG. 3 illustrates a cross-sectional view of a toilet according to an exemplary embodiment of the present disclosure.

FIG. 3 illustrates a cross-sectional view of a toilet 100 according to an exemplary embodiment. The toilet 100 may be a skirted toilet 10 or a non-skirted toilet 20 as described above with respect to FIGS. 1 and 2, respectively. The toilet 100 includes a bowl 110, a tank 120, a trapway 180, a first reservoir 130, a second reservoir 140, a first valve 150, and a second valve 160. In some examples, the toilet 100 may further include a cleaning device 170.

The bowl 110 includes a first inlet 111, a second inlet 112, a rim channel 113, rim outlets 114, a bowl inner surface 115, a bowl outlet 116 at the sump, and a bowl top surface 117. The first inlet 111 is configured to be fluidly coupled to a first water source or supply (e.g., the first reservoir 130) and the second inlet 112 is configured to be coupled to a second water source or supply (e.g., the second reservoir 140). The first inlet 111 and the second inlet 112 are fluidly coupled to the rim channel 113. The rim channel 113 fluidly coupled the first inlet 111 and the second inlet 112 to the rim outlets 114. The rim channel 113 is configured to convey a flow of liquid from the first inlet 111 and/or the second inlet 112 to the rim outlets 114. The size and location of the rim channel 113 may vary. The rim channel 113 may extend in the horizontal direction proximate to the bowl top surface 117.

The bowl 110 includes a plurality of rim outlets 114 fluidly connected to the rim channel 113. The rim outlets 114 may extend from the bowl inner surface 115 to the rim channel 113. The rim outlets 114 are configured to convey a flow of water from the rim channel 113 to the bowl 110. For example, the rim outlets 114 may be configured to convey a flow of water from the rim channel 113 to the bowl 110 during a flush cycle of the toilet. The rim outlets 114 may convey a flow of water so that as the flow of water exits the rim channel 113, the flow of water impinges on the bowl inner surface 115. The flow of water may flow along the bowl inner surface 115. The flow of water may rinse the bowl inner surface 115 as the water impinges and/or flows along the bowl inner surface 115, cleaning the bowl inner surface 115. The size, location, and number of rim outlets 114 may vary. In some examples, the plurality of rim outlets 114 may be located on a horizontal plane proximate to the bowl top surface 117.

The bowl 110 further includes a bowl outlet 116 disposed proximate to the bottom of the bowl 110. The trapway 180 may connect the bowl outlet 116 to a drain or soil pipe. The trapway 180 may include a first portion 181 and a second portion 182. A weir 183 may separate the first portion 181 and the second portion 182. The first portion 181 of the trapway 180 may extend from the bowl outlet 116 at an upwardly oblique angle to the weir 183. The second portion 182 may extend from the weir 183 downwardly to the exiting device, such as the drain or soil pipe. During a flush cycle of the toilet, water and waste may flow out of the bowl 110 through the bowl outlet 116, through the trapway 180 and out the drain or soil pipe.

The tank 120 may be disposed on the bowl top surface 117 and connected by a toilet coupling device. In some examples, as illustrated in FIG. 3, the first reservoir 130 and the second reservoir 140 are disposed within the tank 120 with the first water supply and the second water supply fluidly separated. In other examples, the tank 120 may only include one of the first reservoir 130 and the second reservoir 140. For example, the first reservoir may be disposed within the tank and the second reservoir may be located separate from the tank. In another example, the second reservoir may be disposed within the tank and the first reservoir may be located separate from the tank. When a reservoir is not located in the tank 120, it may be located for example, in a wall proximate to the toilet 100.

The first reservoir 130 may be configured to store a first water supply. The first water supply may be grey water. The grey water may be water collected from a wastewater stream in a home, a commercial building or residential building. For example, the grey water may be wastewater collected from a shower, bath, washing machine, dishwasher, or the like. The first reservoir 130 may be connected to a drain for the shower, bath, washing machine, dishwasher, or the like.

The first reservoir 130 may further include a first valve 150 configured to control a flow of the first water supply (e.g., grey water). For example, when the tank 120 is coupled or attached to the bowl 110, the first valve 150 may be aligned with the first inlet 111 of the bowl 110. Accordingly, the first valve 150 may control a flow of grey water from the first reservoir 130, through the first valve 150, though the first inlet 111 and into the rim channel 113. In some examples, during a flush cycle of the toilet 100, the first valve 150 may be configured to only allow a predetermined amount of grey water, comprising the flow of grey water, to flow out of the first reservoir 130. For example, the first valve 150 may be opened for a predetermined period of time during which a predetermined volume of grey water flows through the first valve 150. The first valve 150 may be a solenoid valve, a canister flush valve, a flapper valve, a float valve, or the like. In some examples, in addition to controlling a flow of grey water out of the first reservoir, after the grey water has flowed out of the first reservoir, the first valve 150 may control refilling of the first reservoir 130 with grey water.

In some examples, the first reservoir may include a cleaning device 170 disposed withing the first reservoir 130. The cleaning device 170 may be configured to clean or treat the grey water stored in the first reservoir 130. The cleaning device 170 may include one or more of a filter, an ultraviolet (UV) light, or a chemical dispenser. The cleaning device may be configured to improve the quality of the grey water stored in the first reservoir 130, before the grey water is used during the flush cycle of the toilet 100. For example, the cleaning device 170 may remove particulate matter from the grey water (e.g., using one or more filters), may disinfect the grey water (e.g., using an ultraviolet light), or may disinfect and otherwise treat the grey water by adding one or more chemicals (e.g., improving the color/appearance or smell, adding a chemical to help clean the toilet 100 using the chemical dispenser). In other examples, the grey water may not be treated before being using during a flush cycle of the toilet 100.

The second reservoir 140 may be configured to store a second water supply. The second water supply may be fresh water. The second reservoir 140 may be connected to a source of fresh water, such as, a building water supply (i.e., municipal water source/supply) or a well. The second reservoir 140 may further include a second valve 160 configured to control a flow of the fresh water. For example, when the tank 120 is coupled to the bowl 110, the second valve 160 may be aligned with the second inlet 112 of the bowl 110. Accordingly, the second valve 160 may control a flow of fresh water through the second valve 160, through the second inlet 112, and into the rim channel 113. In some examples, during a flush cycle of the toilet 100, the second valve 160 may be configured to only allow a predetermined amount of fresh water, comprising the flow of fresh water, to flow out of the second reservoir 140. For example, the second valve 160 may be opened for a predetermined period of time during which a predetermined volume of freshwater flows through the second valve 160. The second valve 160 may be a solenoid valve, a canister flush valve, a flapper valve, a float valve, or the like. In some examples, in addition to controlling a flow of fresh water out of the second reservoir 140, the second valve 160 may control refilling of the second reservoir 140 with fresh water.

Figure 4:
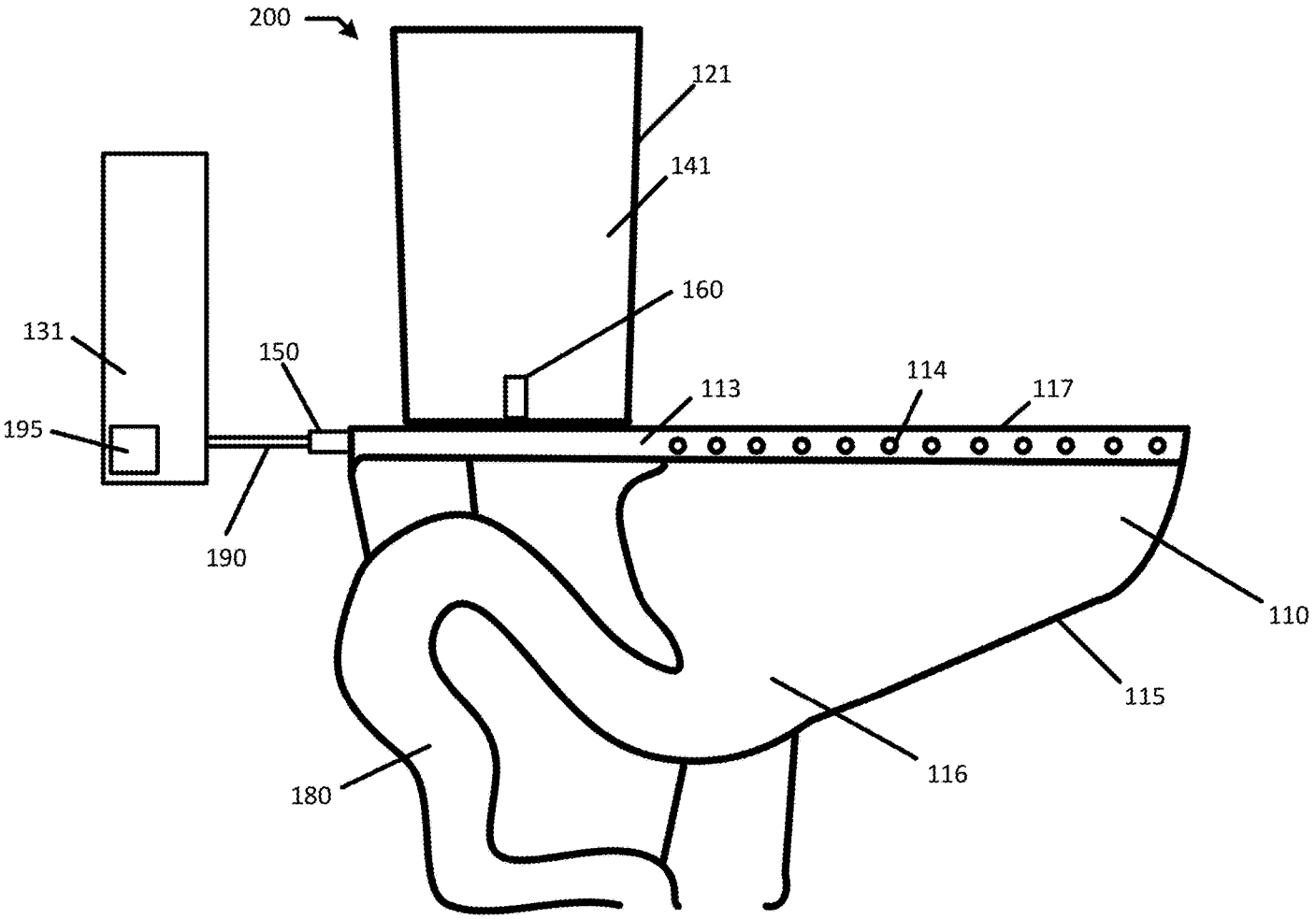
FIG. 4 illustrates a cross-sectional view of a toilet according to an exemplary embodiment of the present disclosure.

FIG. 4 illustrates a cross-sectional view of a toilet 200 according to an exemplary embodiment of the present disclosure. The toilet 200 includes a bowl 110, a tank 121, a trapway 180, a first reservoir 131, a second reservoir 141, a first valve 150, and a second valve 160. The bowl 110, trapway 180, first valve 150, and second valve 160 may be the same as discussed above with respect to the toilet 100 of FIG. 3. In some examples, the tank 121 may be mounted on (e.g., coupled to) the bowl 110 of the toilet. In other examples, the tank 121 may be disposed on the floor of a bathroom or lavatory. In some embodiments, the tank 121 may be disposed in a wall of the bathroom or lavatory. In other examples, the tank may not be located in the bathroom, for example, the tank 121 may be located proximate to an appliance that generates grey water outside of the bathroom or lavatory and may be connected to the bowl 110 using one or more pipes.

In some examples, as illustrated in FIG. 4, the first reservoir 131 may be located or disposed separately from the tank 121. The first reservoir 131 may be configured to store grey water. A reservoir pipe 190 may connect (e.g., fluidly couple) the first reservoir 131 to the bowl 110 of the toilet 200. In this example, the first valve 150 may be disposed between the reservoir pipe 190 and the rim channel 113 of the bowl 110. The first valve 150 may be a solenoid valve configured to control a flow of grey water from the first reservoir 131 and the reservoir pipe 190 into the bowl 110 of the toilet 200. In some examples, the first reservoir 131 may further include a pump 195 configured to pump the grey water from the first reservoir 131, through the reservoir pipe 190, to the first valve 150, through the first valve 150, and into the bowl 110 of the toilet 200.

The first reservoir 131 may be fluidly connected to (e.g., in fluid communication with) a source of grey water, such as, a drain for a bath, shower, faucet, dish washer, washing machine, or the like. The first reservoir 131 may be located in a bathroom or lavatory proximate to the toilet 200. In one example, the first reservoir 131 may be located in a wall of the bathroom or lavatory. In another example, the first reservoir 131 may be located in a cabinet or vanity in the bathroom. In other examples, the first reservoir 131 may be located in the floor. For example, the first reservoir 131 may be connected to a drain for a bath or shower and be located in the floor proximate to the bath or shower. In other examples, the first reservoir 131 may be located outside of the bathroom proximate to an appliance producing grey water. For example, the first reservoir 131 may be located proximate to a dish washer or a washing machine.

In some examples, as illustrated in FIG. 4, the tank 121 may include the second reservoir 141. The second reservoir 141 may be configured to store fresh water. The second reservoir may be connected (e.g., fluidly coupled) to a source of fresh water such as a building water supply or a well. The second valve 160 may be disposed within the tank 121 and the second reservoir 141. The second valve 160 may be configured to control a flow of fresh water from the second reservoir 141 into the rim channel 113 of the bowl 110.

In some examples, the location of the first reservoir 131 and the second reservoir 141 may be interchanged (i.e., the second reservoir may be located separate from the tank 121 and the first reservoir may be located in the tank 121). In these examples, the locations of the first valve 150 and the second valve 160 may also be interchanged. For example, the first valve 150 may be disposed between the reservoir pipe 190 and the bowl 110 and the second valve 160 may be disposed in the tank 121 and the second reservoir 141. Further, in these examples, the pump 195 may be disposed within the second reservoir and may be configured to pump the freshwater from the second reservoir 141 and the reservoir pipe 190 through the second valve 160 and into the rim channel 113 of the bowl 110.

Figure 5:
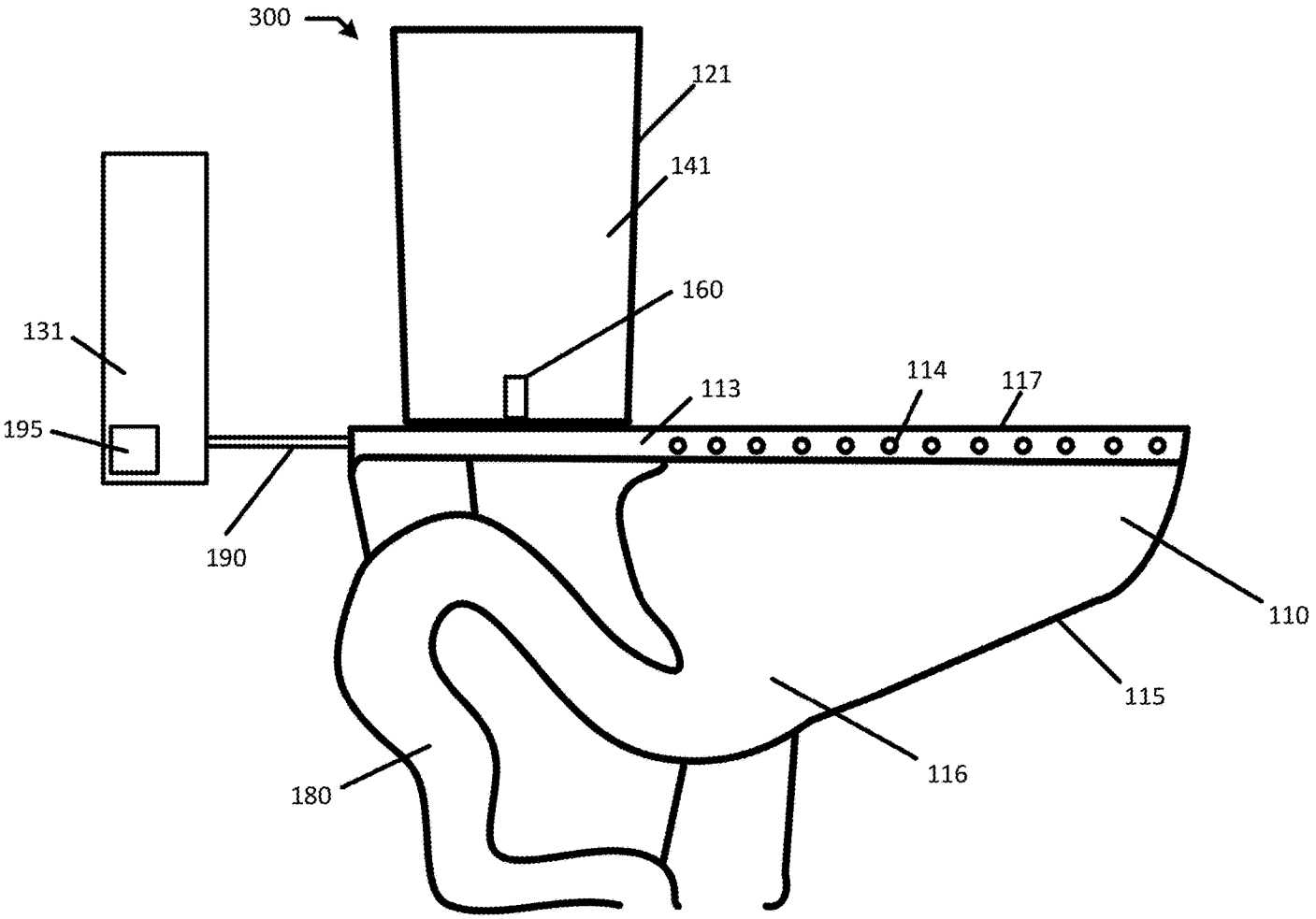
FIG. 5 illustrates a cross-sectional view of a toilet according to an exemplary embodiment of the present disclosure.

FIG. 5 illustrates a cross-sectional view of a toilet 300 according to an exemplary embodiment of the present disclosure. The toilet 300 includes a bowl 110, a tank 121, a trapway 180, a first reservoir 131, a second reservoir 141, a second valve 160, and a pump 195. The toilet 300 may be the same as the toilet 200 described above with respect to FIG. 4; however, the toilet 300 does not include a first valve. Instead, the reservoir pipe 190 may always be fluidly coupled to the rim channel 113 of the bowl 110.

In the toilet 300 as illustrated in FIG. 5 the pump 195 may control the flow of a supply of water (e.g., grey water) from the first reservoir 131, through the reservoir pipe 190, and into the rim channel 113. The pump may be selectively operated (i.e., turned on) to supply or pump water from the first reservoir 131, through the reservoir pipe 190, and into the rim channel 113. The pump 195 may be selectively operated by selectively providing electric current to the pump 195. In some examples, a controller may send control signals to the pump 195.

The pump 195 may be selectively operated to pump water for a predetermined period of time corresponding to a desired period of time in which water (e.g., greywater) flows out of the plurality of rim outlets 114 in the bowl 110. In some examples, the predetermined period of time in which the pump 195 is operated may correspond to a desired amount of water to be outlet from the first reservoir 131 and into the bowl 110 of the toilet 300.

Figure 6:
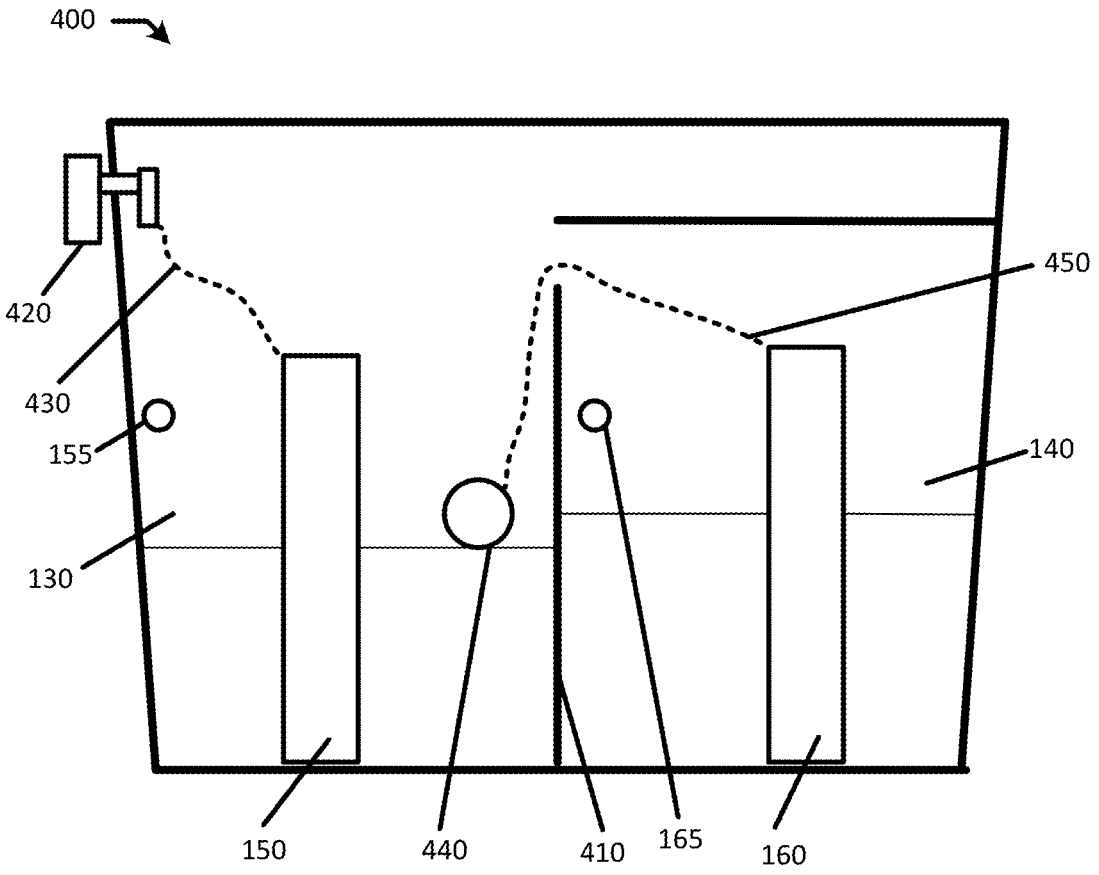
FIG. 6 illustrates a cross-sectional view of a toilet tank according to an exemplary embodiment of the present disclosure.

FIG. 6 illustrates a tank 400 of a toilet according to an exemplary embodiment of the present disclosure. The tank 400 includes a first reservoir 130 including a first valve 150 and a second reservoir 140 including a second valve 160. The tank 400 may further include a separating wall 410, an actuator 420, a first tether 430, a fresh water float 440, and a second tether 450.

The first reservoir 130 and the second reservoir 140 may be fluidly separated by the separating wall 410. The first reservoir 130 may be configured to store grey water and the second reservoir 140 may be configured to store fresh water. The first reservoir 130 may be connected to a source of grey water, for example, a drain for collecting shower or bath water, a dish washer, a washing machine, or the like. The second reservoir 140 may be connected to a source for fresh water, for example, the second reservoir 140 may be connected to a household or commercial water supply, or a well water supply. The source of grey water and the source of fresh water may refill the first reservoir 130 and the second reservoir 140, respectively, after each flush cycle of the toilet. The first valve 150 and the second valve 160 may each control a valve for refilling the first reservoir 130 and the second reservoir 140, respectively.

The actuator 420 on the tank 400 may be used to initiate a flush cycle of the toilet. In some examples, as illustrated in FIG. 6, the actuator 420 may be a lever actuator. In other examples, a different type of actuator, for example, a button actuator or the like may be used. A first tether 430 may connect the actuator 420 and the first valve 150. When a user operates (e.g., rotates) the actuator 420, the first tether 430 may exert a tensile force on the first valve 150. The tensile force exerted on the first valve 150 by the first tether 430 when the actuator 420 is operated may initiate or begin each operational cycle of the first valve.

The first valve 150 may be a solenoid valve, a canister flush valve, a flapper valve, a float valve, or the like. During each operational cycle of the first valve 150, the first valve may be configured to remain open for a predetermined period of time and allow a predetermined volume of grey water to flow out of the first reservoir 130 through the first valve 150 and into the rim channel 113 of the bowl 110. In some examples, after the first valve 150 closes, the first valve 150 may be further configured to allow grey water to flow from a greywater source into the first reservoir 130 for a predetermined period of time refilling the first reservoir 130 with grey water. The tank 400 may include an inlet opening 155 configured to receive grey water from a coupled water supply, such as from a hose (e.g., line, tube). In other embodiments, another device, such as an additional valve may control a flow of grey water used to refill the first reservoir. The first valve 150 or other device (e.g., additional valve) may include a float device for controlling the inlet valve assembly, such as by opening the valve to refill the first reservoir after an operational cycle and closing the valve when the greywater in the first reservoir 130 reaches a preset volume or height. The inlet opening 155 may be on the bottom of the tank.

The tank 400 may further include a fresh water float 440 disposed in the first reservoir 130. The fresh water float disposed in the first reservoir 130 may float on the grey water stored in the first reservoir 130. The tank 400 may further include a second tether 450 connecting the fresh water float 440 and the second valve 160. The second tether 450 may extend over the top of the separating wall 410. When the grey water in the first reservoir 130 falls below a threshold, for example, during an operational cycle of the first valve 150, the fresh water float 440 at a lower height in the first reservoir 130 and a tensile force will be exerted by the second tether on the second valve 160. The tensile force exerted by the second tether 450 on the second valve 160 may initiate an operational cycle of the second valve 160.

The second valve 160 may be a solenoid valve, a canister flush valve, a flapper valve, a float, or the like. During each operational cycle of the second valve 160, the second valve 160 may be configured to remain open for a predetermined period of time and allow a predetermined volume of fresh water to flow out of the second reservoir 140, through the second valve 160, and into the rim channel 113. In some examples, after the second valve 160 closes, the second valve 160 may be further configured to allow fresh water to flow from a fresh water source into the second reservoir 140 for a predetermined period of time refilling the second reservoir 140 with fresh water. The tank 400 may include an inlet opening 165 configured to receive fresh water from a coupled water supply, such as from a hose (e.g., line, tube). In other embodiments, another device, such as an additional valve may control a flow of fresh water used to refill the second reservoir. The second valve 160 or other device (e.g., additional valve) may include a float device for controlling the inlet valve assembly, such as by opening the valve to refill the second reservoir 140 after an operational cycle and closing the valve when the fresh water in the first reservoir 130 reaches a preset volume or height. The inlet opening 165 may be on the bottom of the tank.

Figure 7:
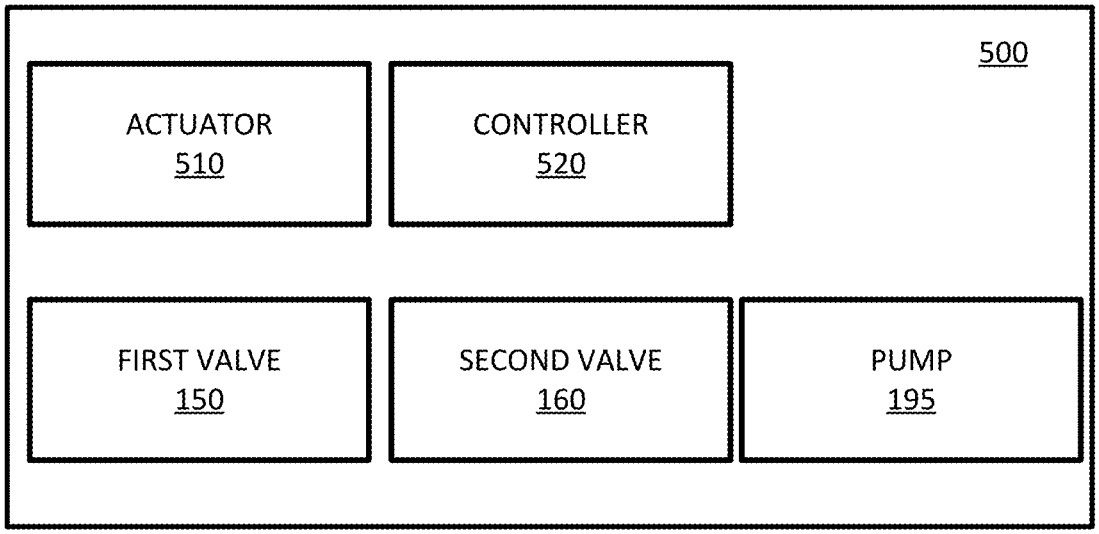
FIG. 7 illustrates a system for controlling a flush cycle of a toilet according to an exemplary embodiment of the present disclosure.

FIG. 7 illustrates a system 500 for controlling a flush cycle of a toilet using grey water according to an exemplary embodiment of the present disclosure. The system 500 may be used with any of the toilets 100, 200, or 300 described herein. For ease of explanation, the system 500 is described below with reference to the toilet 200 of FIG. 4. The system 500 includes an actuator 510, a controller 520, a first valve 150, and a second valve 160. The actuator 510, first valve 150, and second valve 160 are all connected to (i.e., in communication with) the controller 520. In some examples, the system 500 further includes a pump 195 connected to the controller 520.

The actuator 510 is configured to send a flush request signal to the controller 520. In some examples, the actuator 510 may be a push button actuator, lever actuator, capacitive sensor, actuator plate, or the like. The actuator 510 may send a flush request signal to the controller in response to a user operating the push button actuator, lever actuator, capacitive sensor, actuator plate, or the like. In other examples, the actuator 510 may be a sensor configured to collect sensor data proximate to the toilet 200. For example, the sensor may collect sensor data indicative of the presence or lack thereof of a user within a vicinity of the toilet 200. In some examples, the sensor may send the sensor data to the controller 520. In other examples, the actuator 510 may send a flush request signal to the controller based on the sensor data. For example, when the sensor determines that a user is present within the vicinity of the toilet 200 and subsequently determines that a user is not present in the vicinity of the toilet, the actuator 510 may send a flush request signal to the controller 520.

The controller 520 may send one or more control signals and/or electric current to the first valve 150 and the second valve 160 causing the first valve 150 and the second valve 160, respectively, to open and/or close. The controller 520 may initiate a flush cycle of the toilet 200 be sending a control signal to the first valve 150 causing the first valve 150 to open for a predetermined period of time. The controller 520 may subsequently send a control signal to the second valve 160 causing the second valve 160 to open for a predetermined period of time. In some examples, the controller 520 may cause the first valve 150 and the second valve 160, respectively, to open and/or close in one or more sequences corresponding to one or more different flush cycles. The predetermined period of time during which the first valve 150 and/or the second valve 160 remain open may vary depending on a flush cycle selected.

In some examples, the system 500 may further include a pump 195 configured to pump water (e.g., grey water) from the first reservoir 131 to the rim channel 113 of the bowl 110. The controller 520 may send one or more control signals or electric current to the pump 195 in response to a flush request signal. The one or more control signals may cause the pump 195 to start or stop operating (i.e., pumping water). In some examples, the controller 520 may supply or allow electrical current to flow to the pump 195 in response to the flush request signal. The controller 850 may cause the pump 195 to operate in one or more sequences with the first valve 150 and/or the second valve 160.

Figure 8:
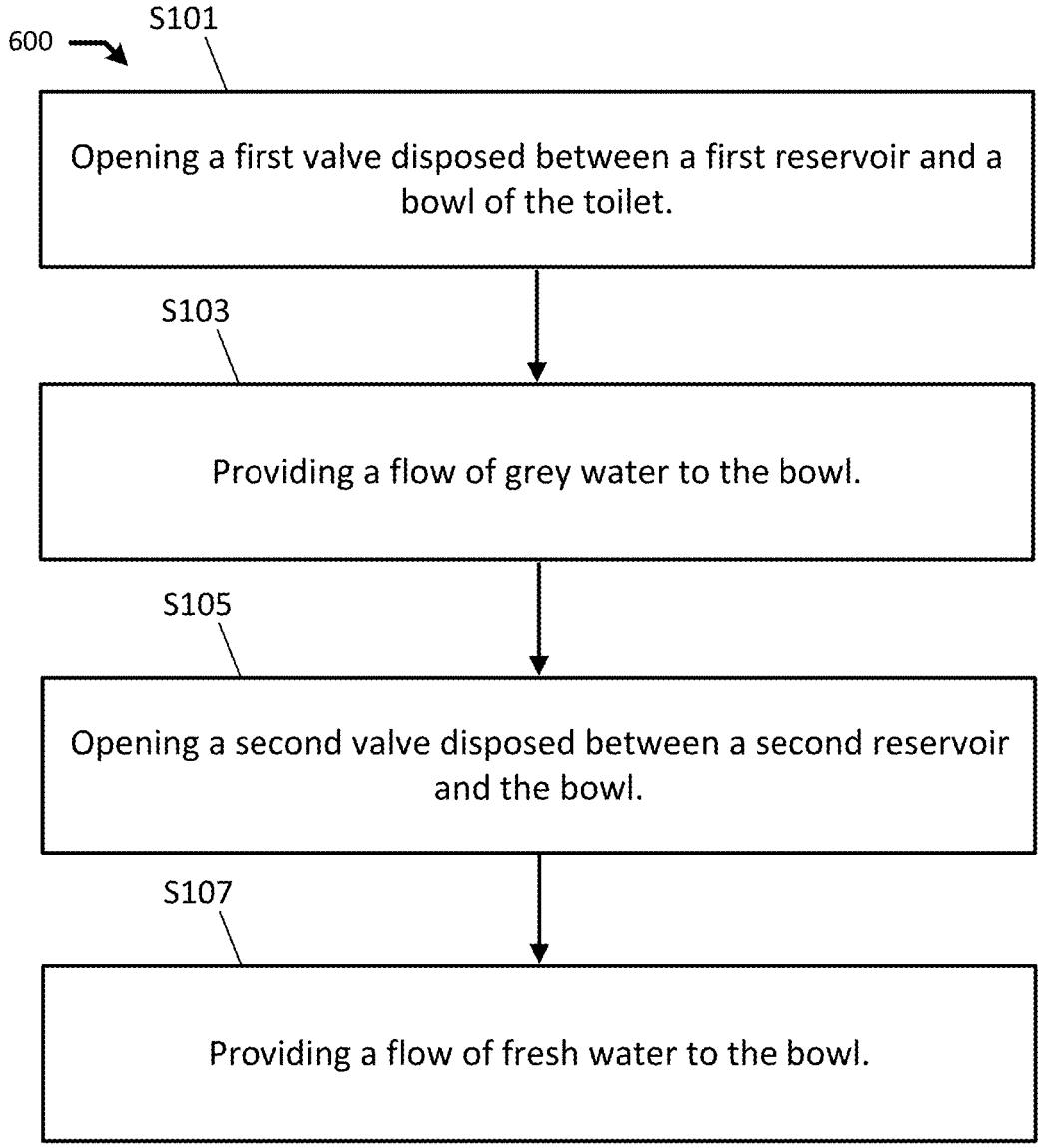
FIG. 8 illustrates a flow chart for a method of flushing a toilet using grey water according to an exemplary embodiment of the present disclosure.

FIG. 8 illustrates a flowchart for a method of flushing a toilet using grey water according to an exemplary embodiment of the present disclosure. The method 600 of FIG. 8 may be used for flushing any of the toilets 100, 200, or 300 described herein. The method 600 of flushing a toilet with grey water is described below with respect to the toilet 100 of FIG. 3. Additional, different, or fewer acts may be provided.

At act S101, a first valve 150 disposed between a first reservoir 130 and a bowl 110 of the toilet 100 is opened. The first reservoir 130 may be configured to store grey water. As the first valve 150 is opened, a flow of grey water may begin flowing from the first reservoir 130, through the first valve 150 and into a rim channel 113 of the bowl 110. The first valve may be opened for a predetermined period of time. The predetermined period of time during which the first valve is opened may depend on a specific flush cycle (of a plurality of available flush cycles) selected. During the predetermined period of time in which the first valve 150 is opened, a predetermined amount of water (e.g., grey water) may flow through the first valve 150. The predetermined period of time during which the first valve 150 is opened may be based on the amount of water flowing through the first valve during the predetermined period of time.

At act S103, a flow of grey water is provided to the bowl 110. The grey water flows from the first reservoir 130, through the first valve 150, through the first inlet 111, into the rim channel 113, through the rim outlets 114, and onto a bowl inner surface 115. The flow of grey water may be provided to the bowl such that as the grey water flows out of the rim outlets 114 it impinges upon the bowl inner surface 115, rinsing the bowl inner surface 115. After impinging on the bowl inner surface 115, the flow of grey water may flow along the bowl inner surface, further rinsing the bowl inner surface.

At act S105, a second valve 160 disposed between a second reservoir 140 and a bowl 110 of the toilet 100 is opened. The second reservoir 140 may be configured to store fresh water. As the second valve 160 is opened, a flow of fresh water may begin flowing from the second reservoir 140, through the second valve 160 and into a rim channel 113 of the bowl 110. The second valve 160 may be opened for a predetermined period of time. The predetermined period of time during which the second valve 160 is opened may depend on a specific flush cycle (of a plurality of available flush cycles) selected. During the predetermined period of time in which the second valve 160 is opened, a predetermined amount of fresh water flow through the second valve 160. The predetermined period of time during which the second valve 160 is opened may be based on the amount of water flowing through the second valve during the predetermined period of time.

The flow of grey water provided to the toilet may be provided to rinse the bowl inner surface 115. In some examples, all of the flow of grey water provided to the toilet may flow through the bowl 110 and out the bowl outlet 116 during the same flush cycle in which the grey water enters the bowl 110.

At act S107, a flow of fresh water is provided to the bowl 110. The fresh water flows from the second reservoir 140 through the second valve 160 and into the rim channel 113. The fresh water flows through the rim channel 113 and through the rim outlets 114 into the bowl 110. The flow of fresh water may impinge on the bowl inner surface 115 after it flows out of the rim outlets 114. In some examples, the fresh water may flow along the bowl inner surface 115. The flow of fresh water may rinse (e.g., clean) the bowl inner surface 115 as it impinges on and/or flows along the bowl inner surface 115. In some examples, the flow of fresh water may be used to fill the bowl 110 of the toilet 100.

In some examples, the flow of grey water may be provided to the bowl before the flow of fresh water is provided to the bowl. For example, the flow of grey water may be provided to the toilet to remove waste from the bowl 110 and/or rinse the bowl inner surface 115 before freshwater is provided to the bowl, filling the bowl. In some examples, the method 600 may further include collecting grey water from at least one of a shower, a bath, or sink. The first reservoir 130 may be fluidly connected to a drain of one or more of a shower, bath, or a sink. The collecting grey water may occur, for example, between flushing cycles, when the shower, bath, or sink are used.

In some examples, the method 700 may further include treating the grey water with at least one of a filter, ultraviolet (UV) light, or a cleaning chemical. The toilet may include a cleaning device, such as cleaning device 170. The cleaning device 170 may be disposed within the first reservoir 131 of the toilet and include at least one of a filter, a UV light, or a chemical dispenser. The cleaning device 170 may treat the grey water, for example, between flush cycles of the toilet.

In some examples, the method 600 may further include pumping the grey water from the first reservoir 130 to the first valve 150. A pump, such as pump 195, may disposed within the first reservoir and configured to pump grey water from the first reservoir 130 to the first valve 150. The pump 195 may pump the grey water from the first reservoir to the first valve 150 for a predetermined period of time corresponding to a predetermined volume of water.

Figure 9:
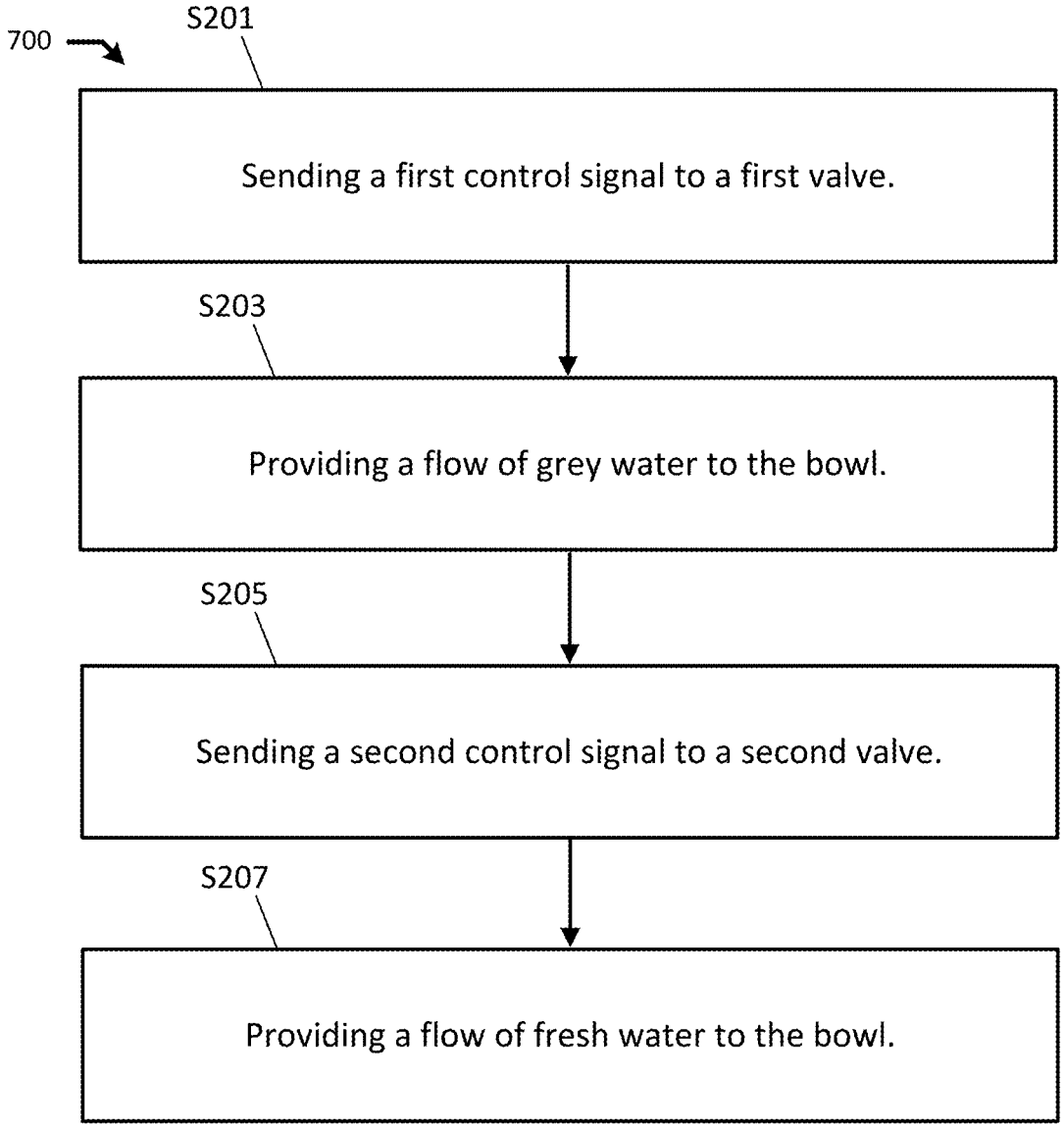
FIG. 9 illustrates a flow chart for a method of flushing a toilet using grey water according to an exemplary embodiment of the present disclosure.

FIG. 9 illustrates a flow chart for a method of flushing a toilet using grey water according to an exemplary embodiment of the present disclosure. The method 700 of FIG. 9 may be used for flushing any of the toilets 100, 200, 300 described herein. The method 700 of FIG. 9 is described below with respect to the toilet 100 of FIG. and the system 500 of FIG. 7. Additional, different, or fewer acts may be provided.

At act S201, a controller 520 sends a first control signal to a first valve 150. The first valve 150 opens in response to the first control signal. The first valve 150 may be configured to open for a predetermined period of time in response to the first control signal. In some examples, the controller 520 may send a first control signal to the first valve 150 to open the first valve and an additional control signal to the first valve to close the first valve. The first valve 150 may comprise a solenoid valve.

As the first valve 150 is opened water (e.g., grey water) may begin flowing out of the first reservoir 131, through the reservoir pipe, through the first valve 150, and into the rim channel 113 of the bowl 110. The first valve 150 may be opened for a predetermined period of time. The predetermined period of time during which the first valve 150 is opened may depend on a specific flush cycle, of a plurality of flush cycles. A predetermined amount of water (e.g., grey water) may flow through the first valve 150 during the predetermined period of time during which the first valve 150 is open.

At act S203, a flow of grey water is provided to the bowl 110. The grey water flows from the first reservoir 131, through the reservoir pipe 190, through the first valve 150, into the rim channel 113, through the rim outlets 114, and onto a bowl inner surface 115. The flow of grey water may be provided to the bowl such that as the grey water flows out of the rim outlets 114 it impinges upon the bowl inner surface 115, rinsing the bowl inner surface 115. After impinging on the bowl inner surface 115, the flow of grey water may flow along the bowl inner surface, further rinsing the bowl inner surface.

At act S205, a controller 520 sends a second control signal to a second valve 160. The second valve 160 opens in response to the second control signal. The second valve 160 may be configured to open for a predetermined period of time in response to the second control signal. In some examples, the controller 520 may send a second control signal to the second valve 160 to open the second valve and an additional control signal to the second valve to close the second valve. The second valve 160 may comprise a solenoid valve.

As the second valve 160 is opened water (e.g., fresh water) may begin flowing out of the second reservoir 141, through the second valve 160, and into the rim channel 113 of the bowl 110. The second valve 160 may be opened for a predetermined period of time. The predetermined period of time during which the second valve 160 is opened may depend on a specific flush cycle, of a plurality of flush cycles. A predetermined amount of water (e.g., fresh water) may flow through the second valve 160 during the predetermined period of time in which the second valve 160 is opened.

At act S207, a flow of fresh water is provided to the bowl 110. The fresh water flows from the second reservoir 141 through the second valve 160 and into the rim channel 113. The fresh water flows through the rim channel 113 and through the rim outlets 114 into the bowl 110. The flow of fresh water may impinge on the bowl inner surface 115 after it flows out of the rim outlets 114. In some examples, the fresh water may flow along the bowl inner surface 115. The flow of fresh water may rinse (e.g., clean) the bowl inner surface 115 as it impinges on and/or flows along the bowl inner surface 115. In some examples, the flow of fresh water may be used to fill the bowl 110 of the toilet 100.

In some examples, the flow of grey water may be provided to the bowl before the flow of fresh water is provided to the bowl. For example, the flow of grey water may be provided to the toilet to remove waste from the bowl 110 and/or rinse the bowl inner surface 115 before freshwater is provided to the bowl, filling the bowl. In some examples, the method 700 may further include collecting grey water from at least one of a shower, bath, or sink. The first reservoir 131 may be fluidly connected to a drain of one or more of a shower, bath, or sink. The collecting grey water may occur, for example, between flushing cycles, when the shower, bath, or sink are used.

In some examples, the method 700 may further include treating the grey water with at least one of a filter, ultraviolet (UV) light, or a cleaning chemical. The toilet may include a cleaning device, such as cleaning device 170. The cleaning device 170 may be disposed within the first reservoir 131 of the toilet and include at least one of a filer, a UV light, or a chemical dispenser. The cleaning device 170 may treat the grey water, for example, between flush cycles of the toilet.

In some examples, the method 700 may further include sending by the controller 520 a third control signal to a pump, such as pump 195, configured to pump grey water from the first reservoir 131 to the first valve, the third control signal may be configured to turn the pump on. The pump 195 may be disposed within the first reservoir 131. The pump may pump the grey water from the first reservoir 131 to the first valve 150. The pump 195 may pump the grey water from the first reservoir to the first valve 150 for a predetermined period of time corresponding to a predetermined volume of water.

Figure 10:
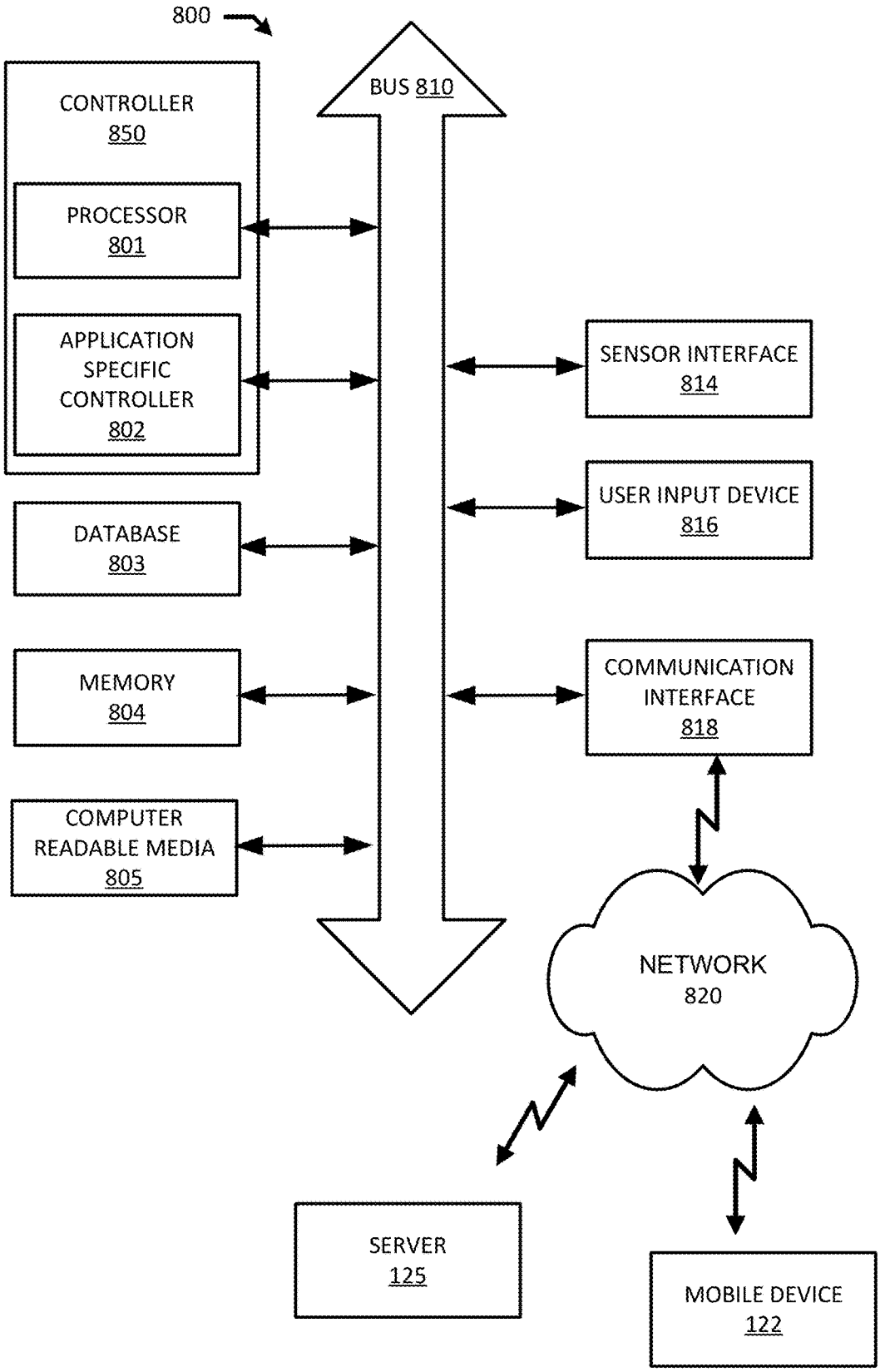
FIG. 10 illustrates an apparatus for controlling a flush cycle according to an exemplary embodiment of the present disclosure.

FIG. 10 illustrates an apparatus 800 for controlling a flush cycle according to an exemplary embodiment of the present disclosure. The apparatus 800 includes a bus 810 facilitating communication between a controller that may be implemented by a processor 801 and/or an application specific controller 802, which may be referred to individually or collectively as the controller 850, and one or more components including a database 803, a memory 804, a computer readable medium 805, a sensor interface 814, a user input device 816, and a communication interface 818. The communication interface 818 may be connected to the internet and/or other networks 820. Additional, different, or fewer components may be included.

The communication interface 818 may include any operable connection. An operable connection may be one in which signals, physical connections, and/or logical communications may be sent and/or received. An operable connection may include a physical interface, an electrical interface, and/or a data interface. The communication interface provides for wireless and/or wired communications in any known or later developed format. The communication interface 818 may be connected to the internet and/or other networks. The communication interface 818 may receive commands (e.g., a command to initiate a flush cycle) from the server 125 and/or one or more mobile devices 122 via the internet and/or other networks 820.

A user may input one or more commands through the user input device 816. For example, a user may input a flush command using the user input device 816. The user input device 816 may be, for example, a push button actuator. In other examples, the user input device may be a capacitive sensor, actuator plate, or the like.

The sensor interface 814 may be in communication with any type of sensor configured to detect the presence and/or absence of a user within the proximity of the toilet. The controller 850 may receive sensor data indicative of the presence of a user and/or usage of the toilet through the sensor interface 814. The controller 850 may initiate a flush cycle in response to the sensor data.

The controller 850 may receive commands from the communication interface 818 and/or the user input device 816. The controller 850 may store information, such as the occurrence, time of, and type of flush command received in the database 803 and/or memory 804 for analysis.

The memory 804 may be a volatile memory or a non-volatile memory. The memory 804 may include one or more read only memory (ROM), random access memory (RAM), a flash memory, an electronic erasable program read only memory (EEPROM), or other type of memory. The memory 804 may be removable from the apparatus 800, such as a secure digital (SD) memory card.

The memory 804 and/or the computer readable medium 805 may include a set of instructions that can be executed to cause the controller 850 to perform one or more of the methods or computer-based functions disclosed herein. For example, the controller 850 may selectively supply electric current to the first valve 150 and the second valve 160, causing each of the first valve 150 and the second valve 160, respectively, to open (i.e., allowing grey water and/or fresh water to flow through the valves). In other examples, the controller 850 may send a control signal to the first valve 150 and the second valve 160, causing the first valve 150 and the second valve 160, respectively, to open.

The controller 850 may cause the first valve 150 and/or the second valve 160 to open for a predetermined period of time. The controller 850 may cause the first valve 150 and the second valve 160 to open and close in one or more predetermined sequences. For example, the controller may be configured to cause the first valve 150 to be opened for a first predetermined period of time and may subsequently cause the second valve 160 to be opened for a second predetermined period of time.

The controller 850 may selectively operate (i.e., turn on) the pump 195, causing the pump to provide (e.g., pump) water from the first reservoir 131 to the rim channel 113 of the toilet. The controller 850 may selectively operate the pump 195 for a predetermined period of time. The controller 850 may selectively operate the pump 195 in one or more sequences with the first valve 150 and the second valve 160.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the system as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

When a component, element, device, or the like of the present disclosure is described as having a purpose or performing an operation, function, or the like, the component, device, or element should be considered herein as being "configured to" meet that purpose or to perform that operation or function.

What is claimed is:

1. A grey water rinse toilet, the toilet comprising:
- a first reservoir configured to store a first water supply comprises grey water;
- a second reservoir configured to store a second water supply comprises fresh water;
- a bowl having a first inlet fluidly connected to the first reservoir and a second inlet fluidly connected to the second reservoir;
- a trapway connecting the bowl to a drain or soil pipe;
- a first valve configured to control a flow of the first water supply from the first reservoir to the bowl, the flow of the first water supply being configured to rinse an inner surface of the bowl; and
- a second valve configured to control a flow of the second water supply from the second reservoir to the bowl.

2. The toilet of claim 1, wherein the first reservoir and the second reservoir are disposed within a tank of the toilet with the first water supply and the second water supply fluidly separated.

3. The toilet of claim 1, wherein the first reservoir is disposed in the tank and the second reservoir is located separate from the tank.

4. The toilet of claim 1, wherein the second reservoir is disposed in the tank and the first reservoir is located separate from the tank.

5. The toilet of claim 1, further comprising:
- a pump configured to pump the first water supply from the first reservoir to the first valve.

6. The toilet of claim 1, wherein the first reservoir is fluidly connected to a drain for a shower, a bath, or a sink.

7. The toilet of claim 1, wherein the first reservoir includes a filter, an ultraviolet (UV) light, or a chemical dispenser.

8. A method of flushing a toilet using grey water, the method comprising:
- opening a first valve disposed between a first reservoir configured to store grey water and a bowl of the toilet;
- providing a flow of grey water to the bowl, the grey water rinsing an inner surface of the bowl;
- conveying waste through a trapway connecting an outlet of the bowl to a drain or soil pipe;

opening a second valve disposed between a second reservoir configured to store freshwater and the bowl; and providing a flow of fresh water to the bowl of the toilet.

9. The method of claim 8, wherein the flow of grey water is provided before the flow of fresh water.

10. The method of claim 8, further comprising:

filling the bowl of the toilet using the flow of fresh water.

11. The method of claim 8, wherein the first valve is opened for a first predetermined period of time and the second valve is opened for a second predetermined period of time.

12. The method of claim 8, further comprising:

collecting grey water from a shower, a bath, or a sink using a drain connected to the first reservoir.

13. The method of claim 8, further comprising:

treating the grey water with a filter, UV light, or a cleaning chemical.

14. The method of claim 8, further comprising:

pumping the grey water from the first reservoir to the first valve.

15. A method of flushing a toilet using grey water, the method comprising:

sending, by a controller, a first control signal to a first valve disposed between a first reservoir storing grey water and a bowl of the toilet, the first control signal configured to open the first valve for a predetermined period of time, wherein a flow of grey water is provided to the bowl while the first valve is open, the flow of grey water being configured to rinse an inner surface of the bowl;

conveying waste through a trapway connecting an outlet of the bowl to a drain or soil pipe; and sending, by the controller, a second control signal to a second valve disposed between a second reservoir storing fresh water and the bowl, the second control signal configured to open the second valve for a predetermined period of time, wherein a flow of fresh water is provided to the bowl while the second valve is open.

16. The method of claim 15, further comprising:

sending, by the controller a third control signal to a pump configured to pump grey water from the first reservoir to the first valve, the third control signal configured to turn the pump on.

17. The method of claim 15, wherein providing a flow of grey water to the bowl occurs before providing a flow of fresh water to the toilet.

18. The method of claim 15, wherein the first valve and the second valve comprise solenoid valves.

19. The method of claim 15, wherein grey water is collected from at least one of a shower, bath, or sink using a drain connected to the first reservoir.

* * * * *